United States Patent [19]

Ferrebee

[11] Patent Number: 4,632,395

[45] **Date of Patent: * Dec. 30, 1986**

[54] FOOTBALL PLACE/FIELD GOAL KICKING DEVICE

[76] Inventor: David H. Ferrebee, 112 Eady Ct., Elyria, Ohio 44035

[ * ] Notice: The portion of the term of this patent subsequent to Oct. 16, 2001 has been disclaimed.

[21] Appl. No.: 669,219

[22] Filed: Nov. 7, 1984

[51] Int. Cl.[4] ..... A63B 67/00

[52] U.S. Cl. ..... 273/55 B

[58] Field of Search ..... 273/55 B; 446/85, 87, 446/101, 102, 104, 105, 106, 107, 117, 118, 119, 122, 123, 124; 52/693

[56] References Cited

U.S. PATENT DOCUMENTS

| | | | |
|---|---|---|---|
| 735,920 | 8/1903 | Visintini | 52/693 |
| 3,105,686 | 10/1963 | Elsea | 273/55 B |
| 3,439,916 | 10/1965 | Kopp | 273/55 B |
| 3,897,948 | 8/1975 | Gerela | 273/55 B |
| 4,049,267 | 9/1977 | Forrest | 273/55 B |

*Primary Examiner*—Richard C. Pinkham
*Assistant Examiner*—T. Brown
*Attorney, Agent, or Firm*—Gustalo Nunez

[57] ABSTRACT

A football place/field goal kicking training device which holds a football in a position for kicking with a holding pressure which simulates being held by a human holder. The training device is used to help a kicker practice field goal kicking and place kicking under conditions simulating actual play. The training device includes a base and a holding device mounted on said base, and three arm elements pivotal about three axes and in which the three arm elements are elongated members and are internally reinforced by lattice type structural members which effects a lighter and structurally stronger football kicking device.

2 Claims, 5 Drawing Figures

FOOTBALL PLACE/FIELD GOAL KICKING DEVICE

BACKGROUND OF THE INVENTION

The instant invention is directed to a device which is utilized to help a football player practice place kicking and field goal kicking under conditions simulating actual playing conditions. Without a device such as the one contemplated here, it would be necessary to have another person available to hold the ball for the practicing kicker.

It is common knowledge to those sports affectionados who live in the United States that many games and championships are won by teams having the most proficient field goal kickers and place kickers. Many of these have been won with seconds remaining on the game clock thus depriving the other team from having the opportunity to score. In order to be proficient in the art of kicking one must practice, practice and practice. Many times these kicking specialists like to practice their art when on one is around, which is difficult to do without the help of another individual to hold the ball or without the aid of a kicking device, such as that disclosed herein. Of course there are some types of practice kicking devices available and they will be discussed shortly.

The instant invention simulates and almost duplicates the actions of a human being holding the football. When the football is kicked, the holding device falls over thus not disturbing or interfering with the trajectory of the football as it leaves the kicker's foot. The device herein disclosed can be used on natural playing surfaces or surfaces employing artificial turf.

DESCRIPTION OF THE PRIOR ART

Many and various efforts have been made to develop football kicking devices that work, i.e., simulate actual playing conditions.

One of those efforts representative of such a device is disclosed in U.S. Pat. No. 3,897,948 issued to Gerela. Gerela discloses a football place-kicking device adapted to hold a football in a substantially upright position. Gerela further discloses a rigid shaft member connected to a base and extending upwardly from the base at some angle thereto; and an elongated semi-rigid arm, mounted at one end to the shaft member at its upper end and having a free end projecting beyond the edge of the base to engage an upper end surface portion of the football.

Another effort representative of a football kicking device disclosed in U.S. Pat. No. 3,105,686 issued to Elsea. Elsea teaches a device which is rather rigid in nature. What we have here is a football holding device with a vertically spaced holding arm for supplying downward pressure on a vertically positioned football.

Kopp in U.S. Pat. No. 3,439,916 discloses a football kicking device which includes a pair of opposing members for engaging the sides of a football and holding it above the ground in a position for kicking.

Further, Forrest, U.S. Pat. No. 4,049,267 discloses yet another type of kicking device which is L shaped and like Elsea, above, appears to be of the rigid type.

The football kicking device disclosed in copending patent application Ser. No. 478,234, filed Mar. 24, 1983, (U.S. Pat. No. 4,477,077) teaches a football holder which functions according to the one described herein. However, the construction disclosed in the instant application is quite different. The construction disclosed herein is lighter, stronger and more economical to manufacture. The lattice reinforcing members shown here are quite novel for use in a kicking device.

It can be seen that there has been a great deal of activity in training devices for utilization by football kicking specialists. One reason for this is the great deal of interest football has for sports fans in general. Also, it is important to reduce the cost of training kicking specialists which can be done by reducing the number of personnel necessary to help in the training process.

It is submitted that the ideal football holding device would be one that is not mechanically complex, not cost prohibitive and preferably one that could be manufactured by plastic mold injection systems. The training device should be able to hold the football in a substantially vertical position or in an angular position depending on the type of kicking practice desired. The device should be able to simulate the holding pressure of a human holder which must be released instantly upon the kicker making contact with the ball. The instant invention does all of the above and is a device which is surprisingly simple in construction and low in cost.

None of the prior art teaches a football holding device which utilizes three pivotal elements in a series type of arrangement and which is of a type exceedingly simple in construction and economical to manufacture, and which functions very efficiently.

SUMMARY OF THE INVENTION

The football holding training device as contemplated here consists of a base having a support post and an arm attached thereto. The arm consists of three elements, pivotally connected serially to each other. The terminating end, adapted to hold a football is tapered at its end. The training device can hold a football at those angles desired by a place kicker or a field goal kicker, whether he be a traditional kicker or a soccer type kicker. The training device may be used on any type of playing surface and is made of any type of rigid material such as plastic. This device, although made of rigid materials, is rather unrigid in practice because of the multiadjustable pivotal connections holding the device together. The construction of the pivotal connections are similar to what is known as "tongue and groove" connections.

DESCRIPTION OF THE PREFERRED EMBODIMENT

Figure 1:
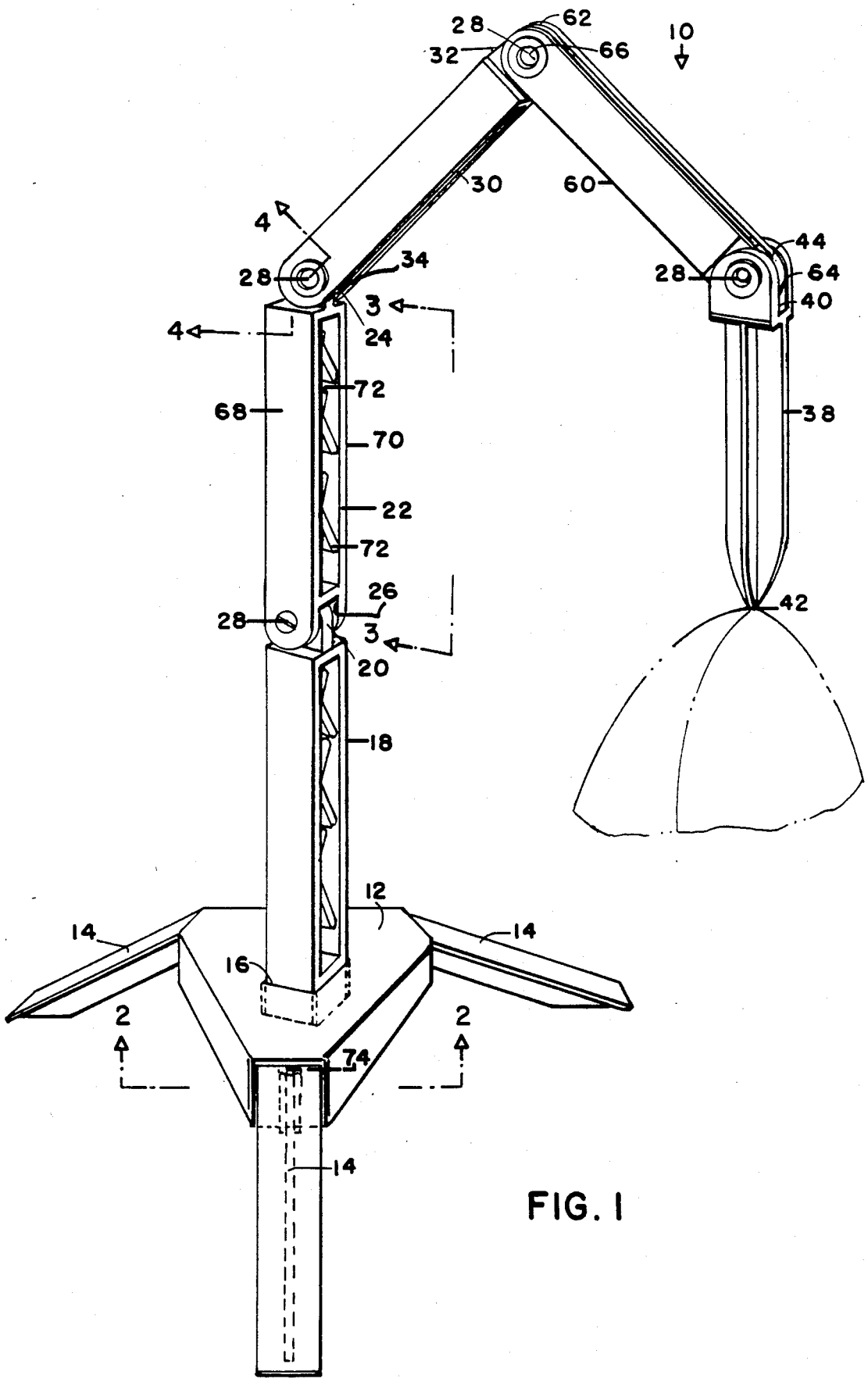
FIG. 1 is a perspective view of the football holding device in accordance with this invention.
Figure 2:
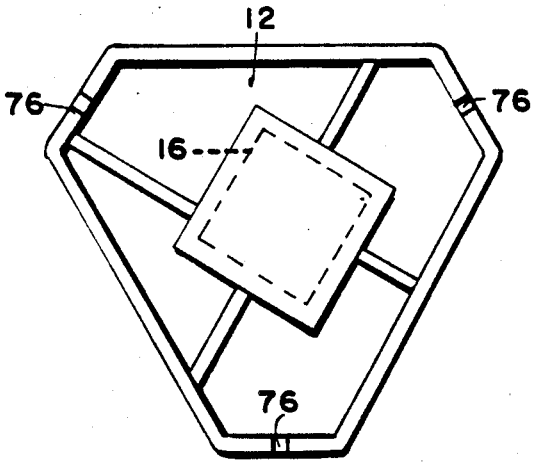
FIG. 2 is a bottom view of the football holding device taken along lines 2—2 of FIG. 1.

Referring now to the drawings and in particular to FIG. 1, there is shown a football kicking device designated by reference numeral 10 and which includes a support base 12 which serves as the only support the kicking device 10 has. In the embodiment shown in FIG. 1, the support base 12 is shown with a plurality of legs 14. The support base 12 is also provided, somewhere center of the support base 12, with an aperture 16, in the embodiment shown, the aperture 16 is in the form of a rectangle. The support base 10 can be manufactured of plastic as one integral unit, including the legs 14 and aperture 16, by well known manufacturing methods such as by plastic molded injection. The support base 12 can also be formed without the legs 14. The determination as to whether to have legs or not must be made by the user and as to the locale where the device 10 will be used. Parameters which would dictate such a choice would be the type of surface that the kicking device is to be used on such as short grass, high grass or artificial turf. The support base 12 could easily be provided with means for removeably attaching legs 14 thereto.

Figure 4:
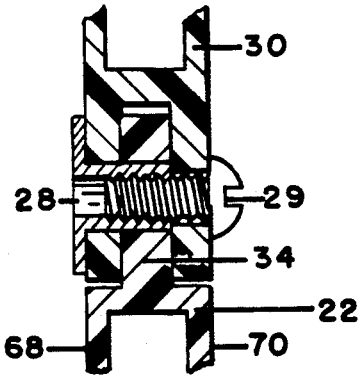
FIG. 4 is a cross-sectional view of a portion of the football holding device taken along lines 4—4 of FIG. 1.

Projecting upwardly from the base 12 is post 18 which terminates in a tongue-like configuration 20. The tongue end 20 is adapted to receive a second arm 22 which at one end terminates in a tongue 24 and at the other end in a slot 26. An opening is provided in the slot 26 and tongue 2θ which when alignment with each other is adapted to receive some connecting means 28 such as a spring biased bolt, 29 shown in FIG. 4, which also functions as a pivot point.

Tongue end 24 is adapted to receive an arm member 30 which at one end terminates in a tongue 32 and at the other end in a slot 34. Again, an opening is provided in slot 34 and tongue 24 which when in alignment with each other receive some fastening means, again such as a spring biased bolt and again functioning as a pivot point at 28.

Tongue end 32 is adapted to receive an elongated structure member 60 with a terminating slotted end 62 and with a terminating tongue end 64. Again an aperture 66 is provided in slot 62 and tongue end 32 which when in alignment with each other receive and are held together by some spring biased bolt and which functions as a pivot point at 28.

Tongue end 64 is adapted to receive a football holding element 38 which at one end terminates in a slotted end 40 and terminates at the other end into a tapered end 42. An opening is provided in slotted end 40 and tongue 64 which when in alignment receive a spring biased fastening means 44, which also functions as a pivot point at 28. Post 18 and arm elements 22, 30, 60 and 38, as shown in FIG. 1, are elongated rectangular structural member except for the terminating ends.

Figure 3:
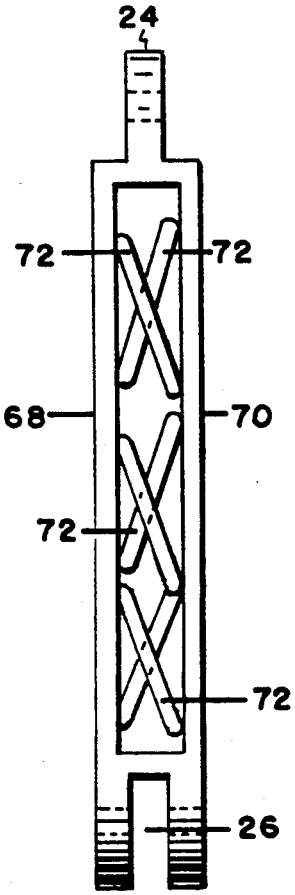
FIG. 3 is a side elevation view of the football holding device taken along lines 3—3 of FIG. 1.

It has been found that arm members 18 and 22 can be formed as one member such as shown in FIG. 3 thus eliminating the connection between arm members 18 and 22. This means that there will be only one arm member extending from the base 12 and connecting to the first pivotal arm member 30.

Referring to FIG. 3, a structure identical to members 18, 22, 30 and 60 is shown. The member consists of 2 sidewalls 68 and 70, tongue 24 and slotted end 26. The sidewalls 68 and 70 are reinforced by lattice type structural members, 72. Looking at the structural member from the side, the members 72 appear to be between the sidewalls 68 and 70 in a crisscross configuration and they are. This type of construction provides for a light structural member, but which is mechanically very strong when compared to its weight.

The fastening means used in the preferred embodiment have been spring biased in nature, however, it is submitted that the fastening means could be replaced by ball and socket connections, thus still providing rotations means for the connection.

Figure 5:
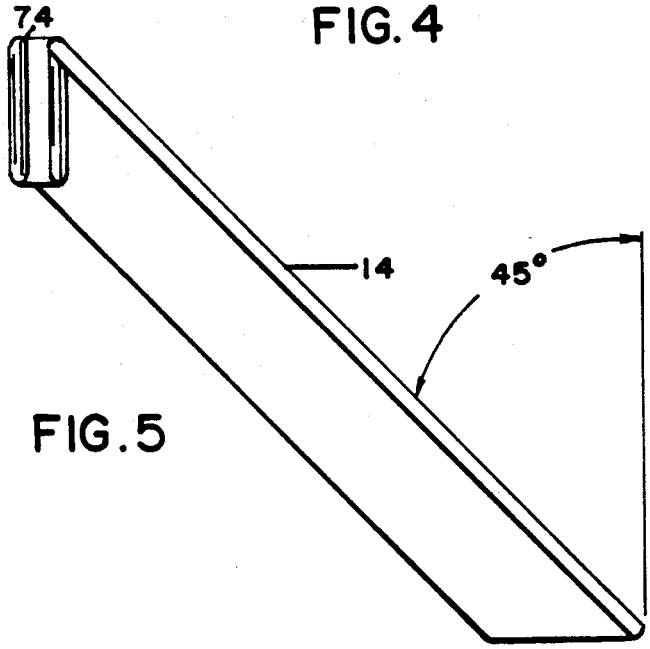
FIG. 5 is a side elevation view of the mounting legs of the football holding device.

Referring now to FIG. 5, which shows one of the mounting support legs 14, it can be seen that the end of leg 14 terminates in a configuration similar to a T 74 at the end which attaches to the support 12. The T end 74 is adapted to be inserted into slots 76 which are formed on the bottom surface of support 12.

The football kicking device 10 as disclosed herein can be used by right and left footed conventional kickers and by right and left footed soccer type kickers with no loss in flexibility of the device 10. Also, the device 10 can be used with different sized footballs, again with no loss in flexibility or efficiency.

The pressure applied to the ball by the device 10 is similar to that applied by a human holder. When the ball is kicked, the device will fall to the side thus not obstructing or interfering with the arc of the kicking foot. As mentioned earlier, this kicking device lends itself well to any surface and can be economically manufactured because of its simple construction. Plastic would be a very desirable material from which to fabricate this kicking device, but it can readily be seen that it can just as easily be made from other materials. Also, the spring biased pivotal elements 22, 30 and 60 and football holder member 38 renders the operation and use of the kicking device into a very simple operation.

Changes may be made in the above described kicking device without departing from the scope of invention herein, it is intended that all matter contained in the above description and shown in the accompanying drawings shall be interpreted as illustrative and not in a limiting sense.

What is claimed is:

1. A football kick training device comprising:

(a) a support base including an aperture centrally located thereon;

(b) an elongated support post, said support post constructed of two elongated sidewalls held together in a spaced relationship by a plurality of crisscrossed members, said support member terminating at one end in a tongue type configuration and including an aperture therethrough on said tongue ending;

(c) a plurality of arm elements pivotally secured to said support post, said arm elements constructed of two elongated sidewalls held together in a spaced relationship to each other by a plurality of crisscrossed members, said arm members terminating at one end in a groove type configuration and at the other end in a tongue like configuration, said groove ends and tongue ends provided with apertures therethrough; and (d) a football engaging arm element pivotally secured to one end of one of said arm members, said football engaging arm element terminating at one end in a tongue for pivotal connection with said terminating arm element and terminating at its other end in the form of a tapered end for engaging a football.

2. A football kick training device comprising:

(a) a support base including an aperture centrally located thereon, said aperture being rectangular in construction, said support base further including a plurality of supporting legs;

(b) an elongated support post including first and second side wall members held together in a spaced relationship to each other by a plurality of crisscrossed members, said support adapted for insertion into said support base aperture, said support post terminating at said other end in a tongue type configuration, and including an aperture on said tongue;

(c) a plurality of arm elements pivotally secured to said support post, said arm elements constructed of two elongated opposing sidewalls held together in a spaced relationship to each other by a plurality of crisscrossed structural members, said arm members terminating at one end in a groove type configuration and having an aperture therethrough, and at the other end in a tongue like configuration and having an aperture therethrough wherein said groove end of one arm is adapted for rotateable connection to a tongue end of another arm member by connecting means inserted into the aperture located on said tongue and groove ends; and (d) a football engaging arm element pivotally secured to one end of said arm elements, said football engaging arm element being constructed in an X-like configuration and terminating at one end in a tongue like configuration for pivotal connection with said terminating arm element and terminating at its other end in a taper type configuration for engaging a football.

* * * * *